US005114132A

United States Patent [19]

Arato et al.

[11] Patent Number: 5,114,132

[45] Date of Patent: May 19, 1992

[54] DEVICE FOR TAKING UP, TRANSPORTING, POSITIONING AND ASSEMBLING A FLEXIBLE, PLANE WORKPIECE

[76] Inventors: Laszlo F. Arato, Seebuchstrasse 19; Ferenc Schell, Beckenriederstr., Chalet Bergfreund, both of CH-6374 Buochs, Switzerland

[21] Appl. No.: 614,020

[22] PCT Filed: Dec. 3, 1987

[86] PCT No.: PCT/CH87/00165

§ 371 Date: Jul. 19, 1988

§ 102(e) Date: Jul. 19, 1988

[87] PCT Pub. No.: WO88/04271

PCT Pub. Date: Jun. 16, 1988

Related U.S. Application Data

[63] Continuation of Ser. No. 269,908, Jul. 19, 1988, abandoned.

[51] Int. Cl.[5] ..... B65H 3/22

[52] U.S. Cl. ..... 271/18.3; 221/213; 294/61

[58] Field of Search ..... 271/18.3, 19–25, 271/141, 264, 268; 294/61, 88; 221/213–216

[56] References Cited

U.S. PATENT DOCUMENTS 4,613,123 9/1986 Franke ..... 271/18.3

FOREIGN PATENT DOCUMENTS 238640 6/1964 Austria .
846649 9/1976 Belgium .
2293388 11/1975 France .
2526771 5/1983 France .

*Primary Examiner*—H. Grant Skaggs
*Attorney, Agent, or Firm*—Darby & Darby

[57] ABSTRACT

A gripper for handling limp workpieces has piercing needles slanting downward on translatable needle bars. Slots in the needle bars slant parallel to the needles and engage stationary pins for constraining the needles to move axially. The needles mutually cross after piercing the workpiece to trap a portion thereof between themselves and a baseplate, thus gripping the workpiece securely without stressing or deforming it. An adjustment thimble with a venier scale limits the piercing depth of the needles. A rectangular housing facilitates juxtaposition of a number of such grippers, which may be conjointly controlled.

7 Claims, 3 Drawing Sheets

Figure 1:
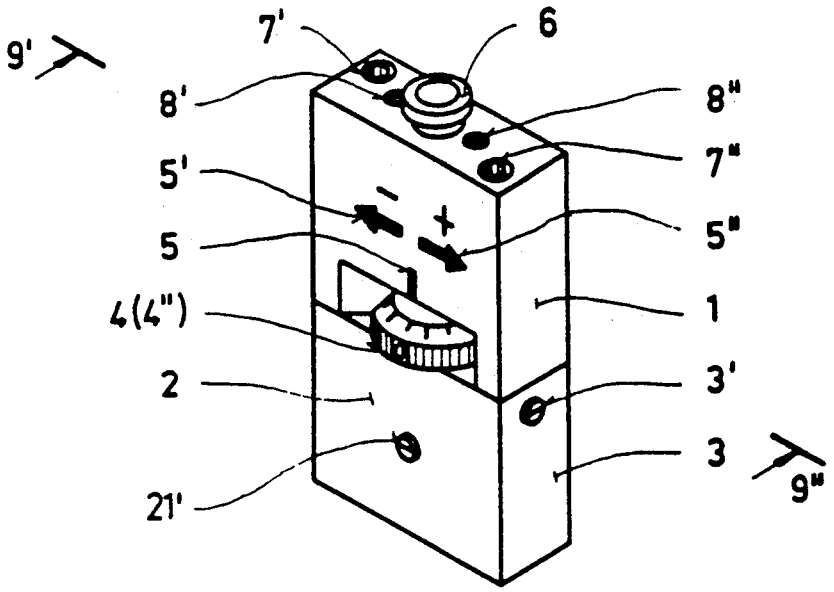

DEVICE FOR TAKING UP, TRANSPORTING, POSITIONING AND ASSEMBLING A FLEXIBLE, PLANE WORKPIECE

This is a continuation of application Ser. No. 269,908, filed Jul. 19, 1988, now abandoned.

The invention relates to a device for taking up, assembling, transporting and positioning a single, plane workpiece in the dry, pre-impregnated or wet state, or a number of such workpieces, with a base plate and at least two needle bars arranged parallel to one another, with needles pointing diagonally downwards, intersecting when viewed from the side, whereby the needle bars are moved divergently during the piercing movement in the direction of the needles only, so that the workpiece pierced by the needles remains closed between the base plate and the needles but loose in its plane.

Such devices are required for taking up, transporting, positioning and assembling fibre-reinforced materials and for the separation of stacked, preferably netted or nonwoven, substantially porous workpieces, in order to be able to include woven, knitted or feltlike fabrics, but also natural and synthetic leather in the making up process or in other treatment, processing, manufacturing or reinforcing processes, manually, mechanically or automatically.

According to the prior art, there is a prevailing view that a device of this kind has to clamp and stretch the workpieces. The proposals in construction and descriptions are in line with this maxim. In order to make this common disadvantage understandable, we would refer you to the processing of fine, so-called surface bonded fabrics, which are used to increase (double !) the long-term impact strength and to increase the chemical resistance of fibre-reinforced plastics. Such substances should be treated aseptically as in the making up of dressings, and would therefore be particularly suitable for machine processing. A bonded fabric made of polyester filament has for instance, at 1½ denier, 15 grammes weight per square metre, a thickness of only 0.07 millimeters. Even if the devices proposed could hold workpieces as fine as these, they would tear the fine structure of the filaments in places as a result of the mechanical stress desired, thereby altering them so that visually distrubing places on the surface and notched places would appear in the resistance test. There is a similar situation for example with the processing of fine leather, which cannot be considered for automatic processing as a result of inevitable damage to the surface caused by the devices according to the prior art. We would also refer specifically to the manufacture of high-performance materials, which are processed dry, or pre-impregnated with a matrix (so-called pre-pregs), or wet, and like the porous materials cannot be taken up, transported or positioned by underpressure. With these workpieces the geometry of the structure is of decisive importance so far as the subsequent resistance quality is concerned, so it should also be possible to take up and maintain these workpieces in their plane without mechanical stresses.

The prior art applicable is the DE 3101705 with a large number of literary references. The device described therein with needle bars and needle pairs, whereof one needle respectively is fixed and the other describes a curve of movement, has the disadvantage that it seeks to clamp and stretch the workpiece. In addition it can only be adjusted to the thickness of the workpieces for separation by means of a complicated height adjustment. A similar construction of the device is described without reference to the need for or possibility of a height adjustment in the Austrian printed patent specification 238640. Here a number of needle bars (referred to therein as carriers of needles) with divergent, i.e. crossed needles are pressed against the workpiece and are then moved in opposition "so that the points of the needles . . . penetrate the layer of fabric (workpiece) and exert a kind of spreading effect, whereby the layer of fabric (workpiece) is held fast" (page 2, lines 27–28).

The device proposed in the DE 3040197 has a central height adjustment, thereby allowing an adjustment to the material thicknesses in batches, but this adjustment can only be effected empirically, i.e. the needles are at risk at their most sensitive place during the adjustment. In addition the type of separation is unsatisfactory, as the proposed hollow needles cannot be definition be pointed needles and are therefore generally speaking unsuitable for the piercing of workpieces. This applies particularly to dry workpieces. Wet and pre-impregnated workpieces or their matrix would also block the hollow needles. The system also has the disadvantage that the piercing of the needles cannot be controlled, as the entire device has to be pressed against the workpiece. It is not certain that after removal of the device from the stack the needles remain in the piercing state, as with the exception of the friction of the seals, no force is effective to keep them in their position. Thus according to experience the workpieces drop down if the device is removed quickly, on account of the mass moment of inertia. As a result of these unreliabilities, these devices are particularly unsuitable for automatic operation, although they have been promoted quite specifically for this type of operation. In addition the wear of the needles in the bent guide ducts is considerable.

With the help of bent needles, which are mounted on the front face in hollow cylinders arranged concentrically to one another and are rotated in an opposite direction to one another for separation, as reported in the EP, publication 0187120, whereby this device thanks to central height adjustment can be adjusted to the thickness of the workpieces for separating. The precise helical movement of the needle points allows the workpiece to be treated with care. With increasing wear however the precision of coaxiality is impaired, making the tearing of the workpiece inevitable. As the height adjustment can also only be effected empirically, the ideal geometry of the bent needles is placed very much at risk when the height is adjusted. If the needle bends deviate from the ideal line of the helix, they cause the damage to the workpiece during the piercing process. A further disadvantage of the appliance derives from the circular construction, whereby the adjusting ring surmounting the housing is regarded as the determinative external diameter for the piled arrangement of the devices shown in the document DE 3040197, especially if the devices are not only to be arranged in the form of a chain but also close to one another. A further disadvantage of these devices is the relatively complicated construction and the outlay on the device that this makes necessary, especially when one considers that for example the said chain-like arrangement calls for a multiplicity of devices per work station, depending on the size of the workpiece.

The U.S. printed U.S. Pat. No. 4,009,786 also shows a device of cylindrical construction with needles pointing downwards and piercing along the jacket line of a fictitious cone. Here it is interesting that the piercing depth of the needles can be adjusted in two stages. Firstly it is possible to select the entire piercing range from 0 to maximum, secondly it is possible to sub-divide this overall stroke as desired. This facility makes it possible to assemble workpieces of varying thicknesses, piled up in two stacks, and for instance to pile them up in a third stack. Applications of this kind are encountered for example in upholstery works, where chair covers are to be brought together with intermediate layers and various upholstery materials. A disadvantage of this device is that, in order not to lose the workpieces, it also clamps by the spring-back of a centrally arranged stopper, creating the disadvantages described at the outset. For this reason the use of such devices in the processing of fine leather, synthetic leather covers or even fine nonwovens can scarely be envisaged. In addition the piercing depths can only be adjusted empirically, placing the fine needle points very much at risk as already explained.

The object of the invention as characterised in the claims is to produce a device for taking up, assembling, transporting and positioning a flexible, plane workpiece, wherein without noticeable traces even fine and delicate workpieces can be safely separated, transported and positioned. For this the device should offer, despite small dimensions and light weight, optimum facilities for building on to the work station, ideal conditions for the directly interlinked arrangement, readily accessible height adjustment with precise indication of the adjustment values for batch operation for a material thickness or a controlled height adjustment for various thicknesses of material with a single layer or a number of layers. The device should also be of simple construction and inexpensive, and should allow expansion of the functions, in particular for computer-assisted automation, e.g. for the control of the loading state, measurement of the material thickness and of the contact pressure of the base plate on the stack. In addition, apart from the standard operation with compressed air, it should be possible to use electrical current as a source of power, and finally it should be possible to clean the device at intervals by supplying a medium, e.g. compressed air or a liquid cleansing and rinsing agent, even in the case of automatic operations, so as to clean the area of the needles and needle bars.

Figure 2:
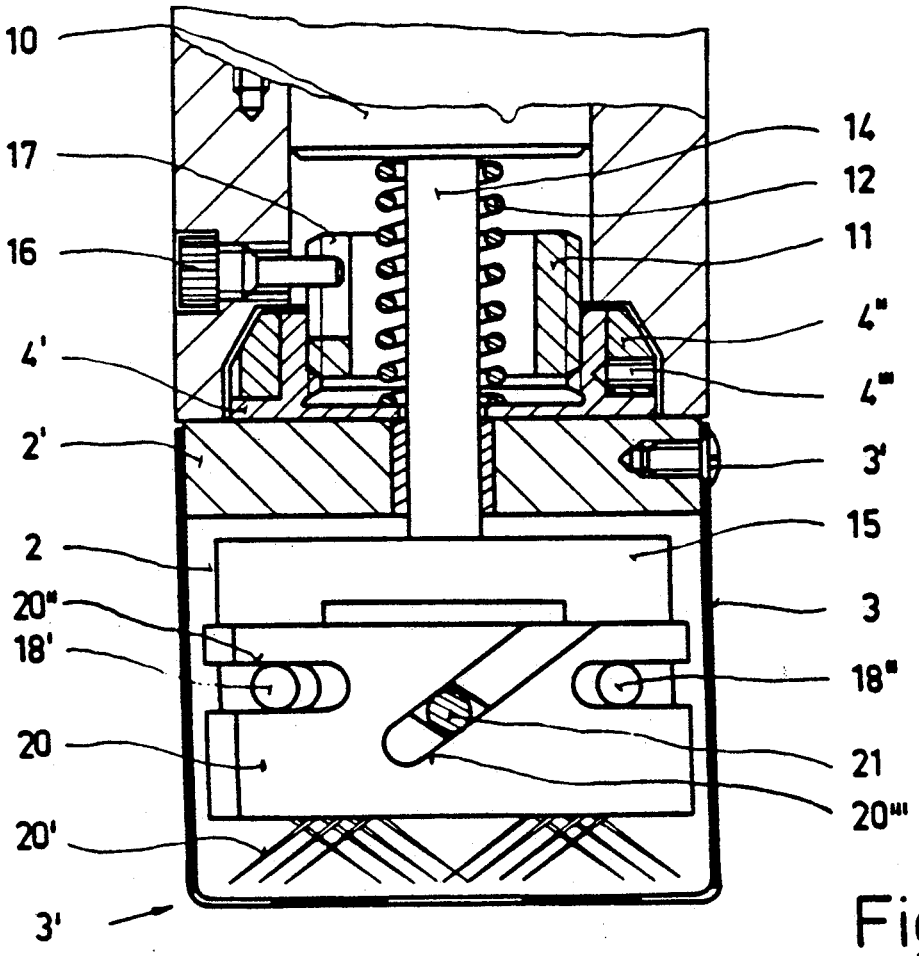
Figure 3:
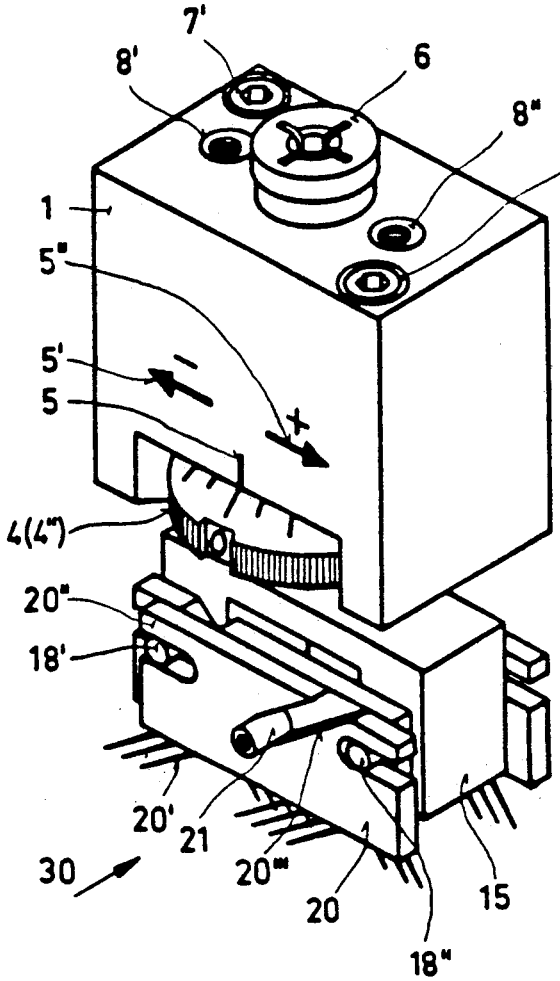
Figure 4:
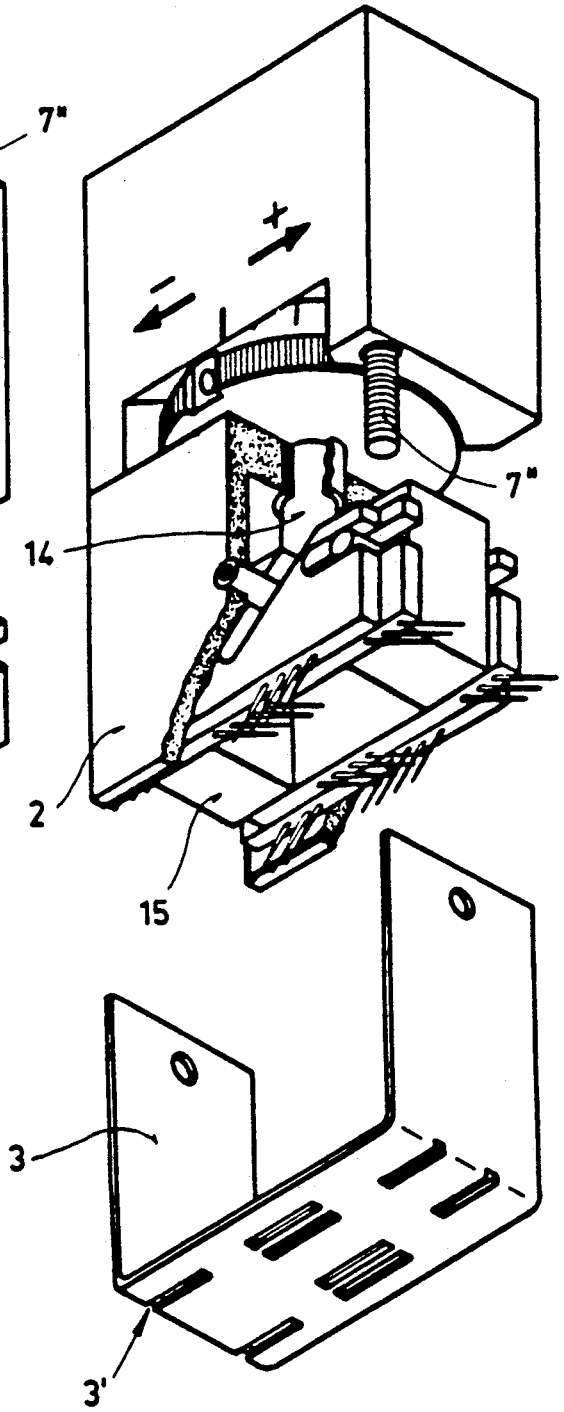
Figure 5:
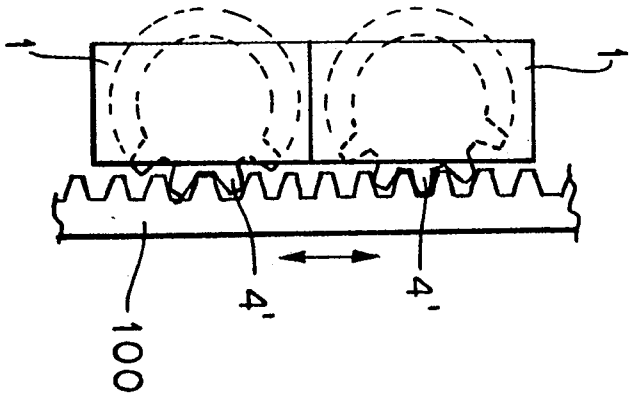

The invention will be described in greater detail below with reference to the drawings, representing an embodiment, and in which;

FIG. 1 shows a device according to the invention, represented isometrically, with integrated pneumatic drive and height adjustment for batch operation, FIG. 2 shows the detail of the needle bars with height adjustment in section, FIG. 3 shows the device with the needles retracted, without base plate, represented isometrically, FIG. 4 shows the device with the needles extended and the base plate dismantled, represented isometrically, FIG. 5 shows several devices in accordance with the invention linked together for simultaneous adjustment.

The device shown in FIG. 1 for taking up, transporting, positioning and assembling flexible, plane workpieces shows a squared, i.e., substantially rectangular, block construction with a compressed air pipe connection 6 and threaded holes 8' and 8'' for clamping to a handle, not shown, or to an operating machine. It consists of a housing top part 1 and bottom part 2, and a base plate 3, drawn up on the sides of the bottom part 2 of the housing and let in, which base plate is fixed on both sides by the screws 3'. It has a rotary knob 4, partly set into the top part of the housing and operable on both sides, with knurled ring and vernier scale 4'', and a vernier on the top part of the housing 5 with reference marks for operating the height adjustment 5' and 5''. In addition the arrows 9' and 9'' show the viewing direction of the section for FIG. 2. Bolts 7' and 7'' hold the top part 1 to the bottom part 2.

FIG. 2 shows the device in the unoperated, i.e. rest condition. This is why the piston 10 is not in contact with the threaded bushing or stop 11 is not in the stop and the return spring 12 is not compressed. As the anchor screw 16 engages in a groove 17 of the threaded bushing 11, the threaded bushing 11 is height-adjusted by turning the rotary knob 4, consisting of the knurled ring with vernier scale 4'', adjusting screw 4''' and back-up ring 4'. Thus the rotating movement is transformed into a longitudinal or axial movement, as the co-rotation of the threaded bushing 11 is hampered by the anchor screw 16. By means of a fine thread on the threaded bushing 11 and on the back-up ring 4', the adjusting movement is reduced so that the accuracy of the adjustment can without difficulty be a fraction of hundredths of a millimeter. To be able to bring the initial position into line with the vernier 5 and the vernier scale of the knurled ring 4'', the knurled ring with vernier scale 4'' is fulcrumed, i.e., rotatably journaled on the back-up ring 4' for assembly. Only when this conformity has been achieved are both components combined by the adjusting screw 4''' to form one component, and thus the rotary knob.

The piston rod 14 is connected to the guide piece 15 by means of a press fit. On both sides of the guide piece 15, between guide piece 15 and the wall of the bottom part of the housing 2, 2', needle bars 20 are arranged in pairs and like a sandwich, supported in each case by two shared moving guide bolts or pins 18' and 18''. The vertical movement of the needle bars 20 is taken over by a shared stationary guide bolt for the vertical movement 21. This guide bolt for the vertical movement 21 is set into the side walls of the bottom part 2 of the housing (cf FIG. 4), and is protected on both sides from displacement by means of a screw 21' in each case (cf FIG. 1). Here we would point out that the needle bars 20, as shown in FIGS. 2, 3 and 4, have the same form but are assembled so as to translate in opposition to one another. If at least two gripping devices are used however, it can also be advantageous to equip the gripping devices with needle bars 20 piercing in the same direction. In this case the workpiece is secured by rotating the gripping devices counter to one another by 180°, so that the direction of piercing of the needles faces away from each other. The piercing movement in the direction of the needles 20' of the needle bars 20 is achieved by the fact that the vertical linear movement of the piston 10, the piston rod 14, the guide piece 15 and the guide bolts for the horizontal movement 18' and 18'' emerging from this guide piece 15 is transferred by these two bolts to the needle bars 20 through the guide groove 20''. The needle bars 20 are prevented from executing this vertical linear movement by the guide bolts anchored in the bottom part 2 of the housing for the vertical movement 21 through the guide groove 20'' for, since this groove runs parallel to the needles 20', the needles 20' can only execute a movement in the direction of the needles 20'.

The squared block construction allows the interlinked arrangement of such devices for, as indicated by the openings in the base plate 3' in FIG. 4, these openings are offset against one another so that needles extending beyond the contour of the appliance do not impair each other's piercing movement despite the fact that the appliances are built directly onto one another.

If the upper part 1 of the housing of a device is extended so that the rotary knob 4 is supplemented by at least one transmission member not shown, e.g. by the toothed disc-type development of the back-up ring 4', the mutual adjustment of the piercing depth of a number of devices can be effected from this master device by means of toothed belts, in that with the other devices the knurled ring with vernier scale 4'' is replaced by toothed discs. For this these toothed discs, like the knurled ring with vernier scale 4'', can be secured in the ideal position in each case with the help of adjusting screws 4''.

FIG. 5 illustrates such a construction wherein the rotary knobs 4' are fitted with radially extending teeth. The radially extending teeth of two juxtaposed devices engage a toothed belt 100. The rotary knobs 4' that adjust the travel of the needles can be turned in unison by moving the toothed belt 100. Adjustment in either direction is possible.

The square block construction makes it possible to build on to or integrate in the top part 1 and bottom part 2 of the housing gauges and sensors and other control appliances, e.g. key switches for answer-back signals on the condition of loading or a measuring head for the thickness of the workpiece or workpieces on assembly. If the thickness of the workpieces is so varied that the piercing depth has to be adjusted to each workpiece, the piercing movement of a device can be effected for example by a rev-controlled spindle drive in the open or closed control circuit.

A further possibility is to interlink the adjustment of the piercing depth of the devices by transmission, as already described, so that they can be operated by means of a mutual drive, controlled in an open or closed control circuit.

Depending on the type of material, material parts such as filaments, slubs, portions of size or of the impregnation can build up on the appliance, in particular on the needles 20' and the needle bars 20, and also on their guides. Excessive deposits of this type can lead to breakdowns as a result of seizing, or to wear of the parts. To prevent such breakdowns we recommend the operational blowing out of the needle head 30 consisting of the guide piece 15 and the needle bars 20 and the guide bolts 18', 18'' and 21, using for example compressed air or a cleaning medium. The side walls of the base plate 3 can have corresponding openings for this, not shown. A further possibility is to immerse the gripping devices in a cleaning bath at intervals, and blow them out with a gas such as nitrogen.

We claim:

1. A needle-type gripper comprising:

a housing including a base plate;

at least one pair of needle bars arranged in parallel planes and each having needles extending at a downward angle;

an actuating fork capable of motion toward and away from said base plate; and wherein:

each needle bar of said at least one pair of needle bars is provided with an interrupted slot extending substantially parallel to said base plate;

each needle bar of said at least one pair of needle bars is provided with an angled slot extending substantially parallel to said needles thereof;

said needle bars of said at least one pair of needle bars being formed substantially as mutual mirror images and being arranged in mutual sliding relationship;

three guide pins, a first guide pin of said three guide pins being fixed in relation to said housing and engaging said angled slots, a second guide pin and a third guide pin of said three guide pins being fixed in relation to said actuating fork and engaging said slots that are parallel to said base plate;

said base plate being provided with slits for the passage therethrough of said needles when said actuating fork moves toward said base plate.

2. The device as defined in claim 1, wherein said housing has a substantially rectangular form for facilitating juxtaposition of the device with at least one further such device.

3. The device as claimed in claim 1, wherein said adjustment means is adapted to cooperate with transmission means for operating the device conjointly with at least one further such device.

4. A device as in claim 1, wherein the slits are narrower than the width of said needle bars.

5. A device as in claim 1, wherein there is at least two pairs of needle bars and said at least two pairs of needle bars are parallel.

6. A needle-type gripper comprising:

a housing including a base plate;

at least one pair of needle bars arranged in parallel planes and each having needles extending at an angle toward said base plate, the needles of one said needle bar being oriented transversely to the needles of the other said needle bar;

an actuating fork capable of motion toward and away from said base plate; and wherein:

each needle bar of said at least one pair of needle bars is provided with an interrupted slot extending substantially parallel to said base plate;

each needle bar of said at least one pair of needle bars is provided with an angled slot extending substantially parallel to said needles thereof;

three guide pins, a first guide pin of said three guide pins being fixed in relation to said housing and engaging said angled slots, a second guide pin and a third guide pin of said three guide pins being fixed in relation to said actuating fork and engaging said slots that are parallel to said base plate;

said base plate being provided with an opening for the passage therethrough of said needles when said actuating fork moves toward said base plate.

7. A device as in claim 6, wherein said housing has a substantially rectangular form for facilitating juxtaposition of the device with at least one further such device.

* * * * *